United States Patent [19]

Klein

[11] 3,935,653

[45] Feb. 3, 1976

[54] BEACH BLANKET STAKING DEVICE

[76] Inventor: William H. Klein, 400 Kings Point Drive, Apartment 1131, Miami, Fla. 33160

[22] Filed: Feb. 1, 1973

[21] Appl. No.: 328,736

[52] U.S. Cl. ..... 40/125 H; 40/125 G; 40/155

[51] Int. Cl.[2] ..... G09F 7/18

[58] Field of Search..... 40/125 R, 125 H, 125 N, 40/145 R, 124.5, 128, 125 F, 125 G, 155; 116/63 R, 63 P; 248/156, 451, 452, 453; 135/5 R

[56] References Cited

UNITED STATES PATENTS

| | | | |
|---|---|---|---|
| 958,082 | 5/1910 | Bland | 40/155 |
| 1,025,349 | 5/1912 | Weisberger | 40/125 H X |
| 1,771,039 | 7/1930 | Hedglon | 40/155 X |
| 2,119,483 | 5/1938 | Korndorfer et al. | 40/125 R UX |
| 2,696,058 | 12/1954 | Beyer | 40/155 X |
| 2,840,092 | 6/1958 | Hill | 135/5 R |
| 3,080,166 | 3/1963 | Clark | 40/125 G X |
| R14,827 | 3/1920 | Norman | 40/125 H |

*Primary Examiner*—Hugh R. Chamblee
*Assistant Examiner*—John F. Pitrelli
*Attorney, Agent, or Firm*—Parmelee, Miller, Welsh & Kratz

[57] ABSTRACT

A push-in pull-out peg or stake device having a drive stem and a framelike drive head has been devised primarily for holding-down blankets or covers such as at highly windy beach areas and for, at the same time, serving as an advertising medium.

3 Claims, 10 Drawing Figures

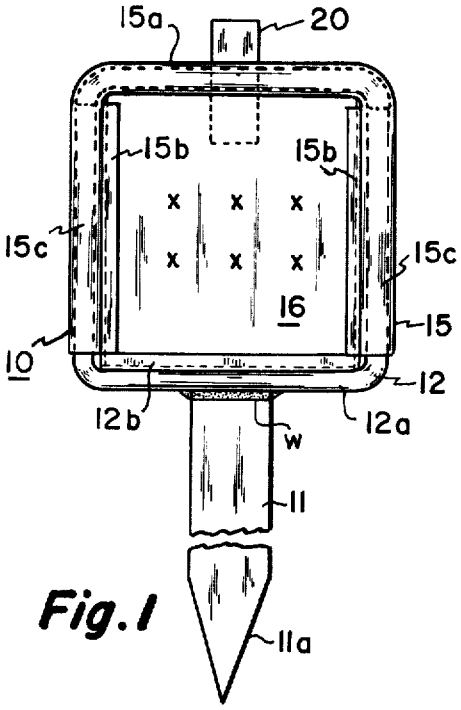
Fig. 1
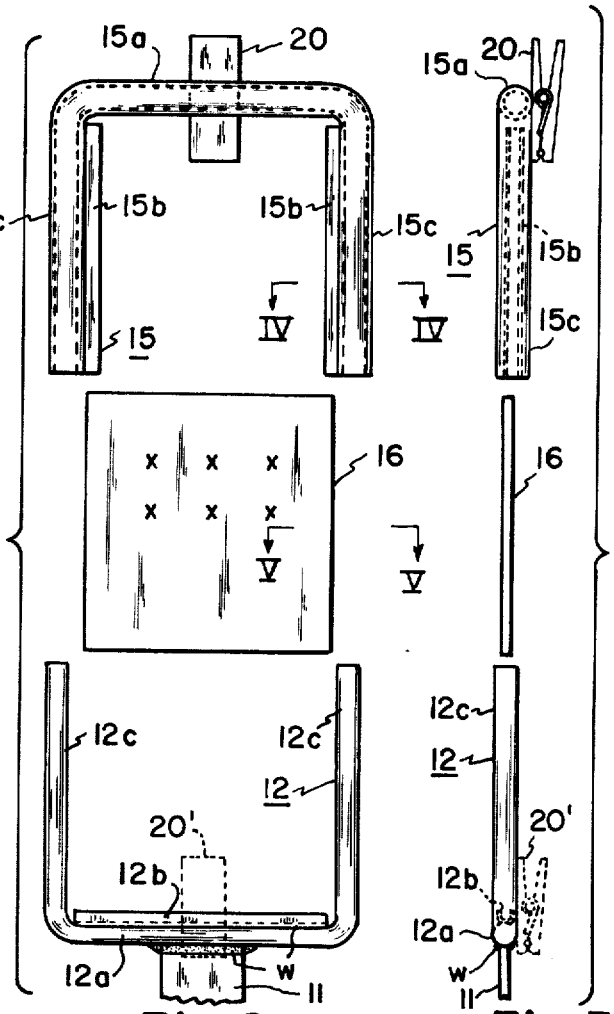
Fig. 2
Fig. 3
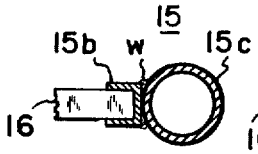
Fig. 4
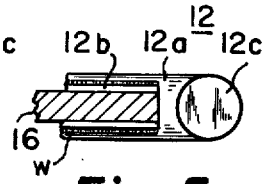
Fig. 5
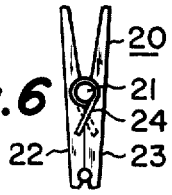
Fig. 6
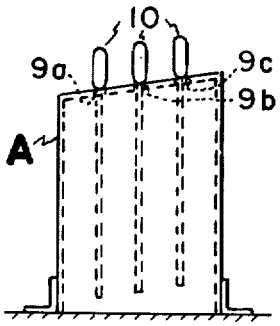
Fig. 7
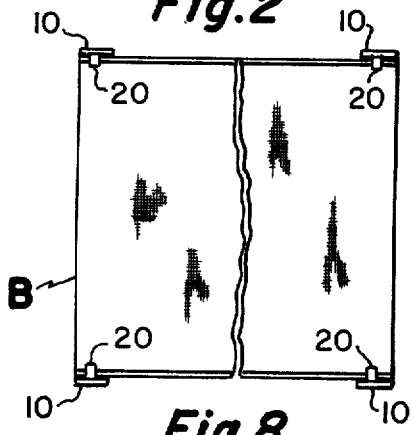
Fig. 8
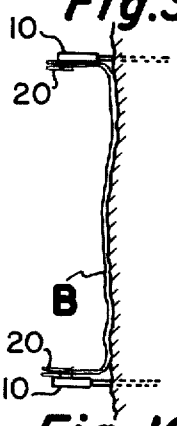
Fig. 10
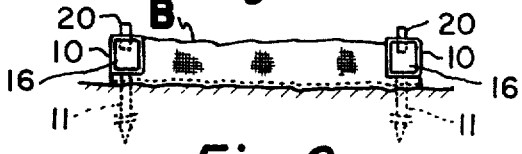
Fig. 9

BEACH BLANKET STAKING DEVICE

BACKGROUND OF THE INVENTION

1. Field of the Invention

The invention relates to a new and improved hold-down or stake means for out-of-door-position retention of ground or beach-covering blanket, tent or tarpaulin means and particularly, to a peg-like or stake device that will effectively meet the need for an inexpensive tie-down means at windy bathing or swimming areas of beaches.

2. Description of the Prior Art

Although there have been stake or peg devices for the general purpose of holding-down items such as blankets, etc., none of them have been too satisfactory, particularly from the standpoint of cost of construction and in utilization. To the best of my knowledge, none have been of a type that may be employed as an effective advertising medium and thus, of a type that can be distributed or loaned free to the user. The need is to subsidize their cost by the use of an advertising or posterlike display engendered by their use. Also, so far as known, none have enabled a cover, such as a blanket or the like to be held in an upright relation along its side edge portions to thus restrict the blowing-in of sand, etc. upon the surface of the cover.

SUMMARY OF THE INVENTION

It has thus been an object of the present invention to devise a stake or peg device that will have a practical utilization for holding-down blankets and other protective coverings, such as at beaches and recreation areas so as to prevent them from being blown out of position or lost due to normal high winds that exist at such areas and, at the same time, will enable advertising of products or services.

Another object of the invention has been to develop a simple and relatively inexpensive but practical form of staking device for blankets and the like which will have a flexibility in its utilization, not only from the standpoint of the manner in which the blanket or other covering is held in position, but also from the standpoint of the employment of an advertising or graphic plaque.

A further object of the invention has been to provide a position-retaining staking device for blankets and the like that has a drive head in the form of an open frame construction defining a picture window for receiving and positioning a graphic plaque or card.

A still further object has been to devise a staking device that can be utilized to grip a blanket and hold its sides turned-up to define a low walled protective enclosure.

These and other objects of the invention will appear to those skilled in the art from the illustrated embodiment and the claims.

BRIEF DESCRIPTION OF THE DRAWINGS

In the drawings,

FIG. 1 is a partically broken-away view in elevation of a complete stake device constructed in accordance with the invention, looking at it from what may be termed an inner side thereof.

FIG. 2 is an exploded fragmental view on the scale of FIG. 1, showing details of the construction of upper and lower frame portions as well as of a graphic plaque that is to be adjustably received and held in position therebetween. This view is taken from the same side of the device as FIG. 1.

FIG. 3 is a narrow edge view in elevation of the device on the scale of FIG. 2 and of the parts shown in such figures.

FIG. 4 is a fragmental enlarged horizontal section taken along the line IV—IV of FIG. 2.

FIG. 5 is a fragmental enlarged horizontal section taken along the line V—V of FIG. 2.

FIG. 6 is an enlarged narrow view in elevation showing details of the construction of a clamp, such as employed in the construction shown in FIGS. 1 to 3, inclusive.

FIG. 7 is a greatly reduced side view in elevation illustrating how stake devices of the invention may be positioned and stored for dispensing to potential users, for example, at a bath house.

FIG. 8 is a greatly reduced broken-away top plan view illustrating the use of staking devices of the invention adjacent four corners of a cover, such as a blanket.

FIG. 9 is a side view in elevation on the scale of and of a cover as pegged-down as shown in FIG. 8.

And, FIG. 10 is an end view in elevation on the scale of and showing the cover of FIG. 8 and how it may be held in position on the ground.

DESCRIPTION OF THE PREFERRED EMBODIMENT

FIGS. 1, 2 and 3 are illustrative of a push-in, pullout peg or staking device 10 constructed in accordance with the invention. A group of devices 10, for example four, may be used, if opposite sides of a blanket or other cover B are to be staked in the manner shown in FIG. 8, or four devices 10 may be used at corners of the cover B or eight adjacent the corners, if the cover is to be held with both its opposite ends as well as its opposite sides in an upright, walling-in or enclosing relationship. The device 10 has a vertically elongated, relatively slender drive stem part 11 which terminates in a tapered or pointed lower end portion 11*a*. As particularly shown in FIGS. 1 and 2, the part 11 may be made of relatively planar, strap or strip-like metal or other suitable material. The upper end of the drive stem part 11 carries an enlarged, upright, framelike, windowdefining, head part which has an upper portion or half 15 and a lower portion or half 12. The portion 12 is directly secured, as by weld metal *w*, to the upper end of the drive stem part 11. The pair of frame portions are each of U-shaped construction, and the upper portion 15 is of hollow tubular construction to slidably, adjustably telescope or fit on the lower portion 12. The lower portion 12 may be either of rodlike or tubular construction, having an outer diameter that enables its pair of legs 12*c* to slidably fit within an opposite pair of legs 15*c* of the upper portion 15.

As particularly illustrated in FIG. 2, the lower frame portion 12 is of bifurcated or U-shaped construction and its pair of legs 12*c* are horizontally spaced-apart to extend upwardly. A horizontal, cross-connecting, bottom leg 12 carries a cross-extending, superimposed, upwardly open, channel-shaped member 12*b* that is secured therealong, as by weld metal *w*, to provide a bottom member for receiving and retaining a picture or graphic plaque 16 therein. The upper frame part 15 is also shown of U-shaped or bifurcated construction, as defined by a horizontal, cross-connecting top leg 15*a* and the pair of vertically downwardly projecting legs 15*c*. Each leg 15*c* carries a superimposed, inwardly open, channel-shaped member 15*b* that is secured therealong, as by weld metal, to provide side members for receiving and retaining the picture or graphic plaque 16 therein and therebetween.

As shown in FIG. 1, the two frame portions 12 and 15 define a plaque-enclosing and receiving window frame which may be adjusted to accommodate different lengths of suitable graphic plaques, pictures or advertising cards 16. Each plaque 16 will be of generally planar construction and may have any suitable advertising, posterlike or pictorial material thereon. It is held in a guided relation between the frame portions by the lower, cross-extending, channel-shaped member 12*b* and the pair of opposite, side-positioned, vertical, side channel-shaped members 15*b*. The plaque 16 may have pictorial material on one or both of its planar sides. It will be apparent that the plaque 16 may be replaced from time to time to change its advertising set-up as desired.

For gripping edges of a blanket such as B, the upper frame portion 15 may have a clamp, spring clipping or cover gripping means 20 secured thereto by weld metal (if of metal construction) to project centrally downwardly in a substantially parallel relation from an outer side of the upper cross leg 15*a*. If desired, a spring clip 20' (shown in dotted lines in FIGS. 2 and 3) may be secured in a like manner to extend from the outer side of the lower cross leg member 12*b* of the frame portion 12. As shown in FIG. 6, the clip 20 (and 20') has a pair of opposed, gripping or clamping fingers 22, 23 that have a common retention pin and pivot member 21 and a tension spring 24 for positioning them with respect to each other and urging them towards the closed position shown. One finger, such as 22, is secured (as by rivets, weld metal or cement) to an associated frame member in such a manner that the clamping fingers 22 and 23 lay in substantially a vertical plane along and corresponding or parallel to the vertical plane of the frame-like drive head part. As shown in FIG. 3, clipping means 20 and 20' are adapted to be opened vertically downwardly.

If the blanket or other covering B is to be gripped close to the ground, then gripping means 20' may be used. Where, however, it is desired to give the sides or ends of the blanket B a protective, vertical, wall-like extension, then the upper clip means 20 may be utilized, as particularly illustrated in FIGS. 9 and 10. For facilitating dispensing and collecting sets of the stake devices 10, a dispensing stand A, such as shown in FIG. 7, may be provided. Suitable openings 9*a*, 9*b*, 9*c*, etc. in a sloped top wall of the stand A, will bypass the blade-like drive stem part 11 of each stake 10, but will serve as a support means for the widthwise enlarged drive head part thereof.

I claim:

1. In an advertising staking device of the character shown and described for ground mounting to securely position side edge portions of a beach blanket and the like in an upright wall-like enclosing position along and with respect to a central body portion thereof that is resting on the ground, an elongated drive stem having a tapered lower drive end, a vertically upright drive head and advertising plaque-receiving frame, said frame being centrally secured on an upper end portion of said stem and having a pair of U-shaped parts adapted to adjustably telescope with respect to each other to define a window portion of variable size, said parts in their telescopic relation having upper and lower spaced-apart cross members and vertical members connected to said cross members, means carried by said frame for receiving and retaining an advertising plaque within said window portion, blanket clipping means having a pair of pivotally connected jaws and spring means for urging said jaws towards a closed relation with respect to each other, one of said jaws being substantially centrally secured to the upper cross member of said upper frame part to mount said jaws to extend in a plane substantially parallel to said frame and in a vertical downwardly opening blanket edge-receiving position, and said clipping means being adapted to receive and retain an adjacent side edge portion of the blanket in an upright wall-like enclosing position along the device.

2. In a device as defined in claim 1 wherein, each of said U-shaped parts has a pair of vertical leg members connected by one of said cross members, the pair of leg members of one of said parts is mounted in a slidable telescopic positioning on the pair of leg members of the other of said parts, and said means for receiving and retaining the advertising plaque is a pair of channel-shaped pieces secured along the inner reaches of the pair of leg members of one of said parts.

3. In a device as defined in claim 1 wherein, a second blanket clipping means of the same construction as said first-mentioned clipping means is provided, and said second means is mounted substantially centrally on said lower cross member in a vertically downwardly opening blanket-receiving position to provide a lower position-hold for a side edge portion of the blanket.

* * * * *